US007472689B2

(12) United States Patent
Ishizuka et al.

(10) Patent No.: US 7,472,689 B2
(45) Date of Patent: Jan. 6, 2009

(54) FUEL INJECTION SYSTEM

(75) Inventors: Koji Ishizuka, Kariya (JP); Takayuki Fukushima, Okazaki (JP); Takashi Kikutani, Ama-gun (JP)

(73) Assignee: Denso Corporation, Kariya (JP)

( * ) Notice: Subject to any disclaimer, the term of this patent is extended or adjusted under 35 U.S.C. 154(b) by 437 days.

(21) Appl. No.: 10/765,892

(22) Filed: Jan. 29, 2004

(65) Prior Publication Data

US 2005/0257777 A1 Nov. 24, 2005

(30) Foreign Application Priority Data

Jan. 30, 2003 (JP) ..... 2003-021880
Aug. 8, 2003 (JP) ..... 2003-289869

(51) Int. Cl.
*F02M 37/04* (2006.01)

(52) U.S. Cl. ..... 123/446; 123/496

(58) Field of Classification Search ..... 123/467, 123/500, 501, 494, 299, 300, 446, 496
See application file for complete search history.

(56) References Cited

U.S. PATENT DOCUMENTS

| | | | | |
|---|---|---|---|---|
| 5,402,760 | A | 4/1995 | Takeuchi et al. | |
| 5,988,143 | A | 11/1999 | Dietz et al. | |
| 6,062,193 | A | 5/2000 | Gatellier | |
| 6,102,009 | A | 8/2000 | Nishiyama | |
| 6,354,274 | B1 | 3/2002 | Shima et al. | |
| 6,516,773 | B2 * | 2/2003 | Dutart et al. | 123/299 |
| 6,722,345 | B2 * | 4/2004 | Saeki et al. | 123/435 |
| 6,807,947 | B2 | 10/2004 | Coates et al. | |
| 7,021,278 | B2 * | 4/2006 | Ishizuka et al. | 123/299 |
| 2001/0019085 | A1 * | 9/2001 | Okajima et al. | 239/585.1 |
| 2001/0022320 | A1 * | 9/2001 | Tojo et al. | 239/5 |
| 2002/0000218 | A1 * | 1/2002 | Rueger et al. | 123/498 |
| 2003/0056761 | A1 * | 3/2003 | Yomogida et al. | 123/461 |
| 2003/0089332 | A1 * | 5/2003 | Yomogida | 123/299 |
| 2003/0089334 | A1 | 5/2003 | Yomogida | |
| 2003/0106533 | A1 * | 6/2003 | Crofts et al. | 123/446 |
| 2003/0213473 | A1 | 11/2003 | Coates et al. | |

FOREIGN PATENT DOCUMENTS

| | | |
|---|---|---|
| EP | 1004764 A | 5/2000 |
| EP | 1 026 384 | 8/2000 |
| JP | 06-058217 | 3/1994 |

(Continued)

OTHER PUBLICATIONS

Chinese Office Action dated Mar. 27, 2006 with translation.

(Continued)

*Primary Examiner*—Thomas N Moulis
(74) *Attorney, Agent, or Firm*—Nixon & Vanderhye P.C.

(57) ABSTRACT

During a short duration injection, a triangular geometry is drawn in terms of the injection rate with respect to time, while a trapezoidal geometry is drawn during a long duration injection. The ON timing of the drive pulse is determined to be at a valve opening pressure achieving time before the start point of formation in time of the geometry. An injection pulse duration is determined from "the valve opening pressure achieving time+a needle rise time−a valve closing pressure achieving time," and then the OFF timing of the drive pulse is determined.

20 Claims, 4 Drawing Sheets

FOREIGN PATENT DOCUMENTS

| | | |
|---|---|---|
| JP | 10-047137 | 2/1998 |
| JP | 10-266888 | 9/1998 |
| JP | 11-141385 | 5/1999 |

OTHER PUBLICATIONS

European Search Report dated Jul. 25, 2006.

Examination Report in corresponding European application No. 04002090.1.

Office Action mailed Oct. 18, 2007 in corresponding Japanese Application No. 2003-289869 with English-language translation.

* cited by examiner

FUEL INJECTION SYSTEM

CROSS REFERENCE TO RELATED APPLICATIONS

This application is based upon, claims the benefit of priority of, and incorporates by reference Japanese Patent Application No. 2003-21880 filed Jan. 30, 2003, and No. 2003-289869 filed Aug. 8, 2003.

1. Technical Field of the Invention

The present invention relates to a fuel injection system for injecting fuel into an internal combustion engine (hereinafter referred to as the engine), and more particularly, to controlling the opening and closing operation that supplies fuel to the injector.

2. Background of the Invention

As an example, reference will be made to a conventional fuel injection system shown in FIG. 5 that employs multiple injections (or multi-stage injections of fuel to be separately carried out a multiple number of times in one cycle). As shown in FIG. 5, in a multiple number of times of injection in one cycle, the second and subsequent stage injections are affected by the previous injection (due to pulsation that occurs in a line for supplying fuel to the injector), which leads to a variation in injection commencement delay or injection termination delay. This will be described more specifically with reference to the lower portion of FIG. 5.

Suppose that a drive pulse as shown in the lower portion in FIG. 5 is provided to the injector in the absence of pulsation. In this case, the injection rate starts rising from the point in time at which the valve opening pressure achieving time Tds has elapsed after the drive pulse is generated, and starts falling from the point in time at which the valve closing pressure achieving time Tde1 has elapsed after the drive pulse is terminated. Thus, the geometry drawn in terms of the injection rate takes the shape of a reference triangle, as shown in FIG. 5. An injection quantity Q' to be actually injected from the injector is a quantity corresponding to the area of the reference triangle.

Suppose that the effect of pulsation causes an increase in fuel pressure to be supplied to the injector. In this case, in general, the valve opening pressure achieving time Tds is reduced by the amount of arrow (1) of FIG. 5, while the maximum injection rate is increased as shown by arrow (2), and the needle falling time Tde2 is extended as shown by arrow (3). As a result, the geometry drawn in terms of the injection rate takes the shape of a larger triangle, as shown in FIG. 5. That is, the injection quantity Q' that is actually injected from the injector is a quantity corresponding to the area of the larger triangle, thus causing the injection quantity to be larger than the request injection quantity Q.

To the contrary, a decrease in fuel pressure to be supplied to the injector due to the effect of pulsation would cause the geometry drawn in terms of the injection rate to be smaller than the reference triangle, thus making the injection quantity less than the request injection quantity Q. The effect of pulsation would also vary the pressure of fuel to be supplied to the injector thereby causing a variation in the valve opening pressure achieving time Tds. This causes a deviation in actual injection timing before or after the request injection start timing made by the controller.

In the prior art, independently provided were a correction map for determining the valve opening pressure achieving time Tds varied by pulsation, a correction map for determining the valve closing pressure achieving time Tde1 varied by pulsation, and a correction map for determining the injection quantity varied by pulsation, in addition to a map for determining a fundamental pulse duration of the injector from the fundamental injection quantity and a common rail pressure. In these respective maps, an independent operation was carried out to correct the output timing of a drive pulse, thereby preventing a variation in injection quantity due to the effect of pulsation (e.g., see Japanese Patent Laid-Open Publication No. Hei 10-266888).

In the prior art mentioned above, even to solve a drawback caused by one factor, such as the effect of pulsation, it is necessary to use a number of independent correction maps to separately determine the valve opening pressure achieving time Tds, the valve closing pressure achieving time Tde1, and the injection quantity, which are varied by pulsation, and use the resulting values for correction of the output timing of drive pulses.

Accordingly, for example, in multi-stage injection, it is necessary to perform an operational step using a number of independent correction maps by the number of the injection stages, thereby imposing a very heavy operational load on a controller. This load is caused by the multiple operation steps of correcting the drive pulse and thus an enormous number of adaptation steps are required for the operational step.

SUMMARY OF THE INVENTION

The present invention was developed in view of the aforementioned problems. It is therefore the object of the present invention to provide a fuel injection system that allows for the reduction of the adaptation steps to correct the output duration and timing of a drive pulse for drivingly closing or opening an injector.

The fuel injection system employing the means according to a first aspect determines a geometry defined by a change in injection rate of the injector with respect to time, and drive signal generation timing and drive signal termination timing of the injector from the geometry of the injection rate having an area corresponding to the request injection quantity Q. As described above, the fuel injection system employing the means according to the first aspect determines the drive signal generation timing and the drive signal termination timing of the injector from the geometry of the injection rate having an area corresponding to the request injection quantity Q. Accordingly, this permits an operational result (the formation of the geometry of the injection rate) based on a certain factor (e.g., a change in valve opening pressure achieving time Tds) to be automatically reflected on another operational result (such as the drive signal generation timing or the drive signal termination timing that is derived from the geometry of the injection rate). It is thus possible to significantly reduce the adaptation time required of the controller. The fuel injection system employing the means according to a second aspect determines the geometry defined by a change in needle lift quantity of the injector with respect to time and converts the geometry of needle lift quantity to determine the geometry of the injection rate.

The fuel injection system employing the means according to a third aspect allows the determination of the geometry of the injection rate by converting the geometry of the needle lift quantity to include dividing an injection region into a seat aperture region and an injection hole aperture region. In the seat aperture region, an injection quantity is determined between a needle and a nozzle seat of the injector, while in the injection hole aperture region, an injection quantity is determined in accordance with an aperture level of an injection hole of the injector. Also included are making a linear approximation of injection flow rate against needle lift quantity characteristics in the seat aperture region for an injection rate against needle lift quantity conversion, and making a linear approximation of injection flow rate against needle lift quantity characteristics in the injection hole aperture region for an injection rate against needle lift quantity conversion.

The fuel injection system employing the means according to a fourth aspect allows the geometry of the injection rate to be drawn at least using a pressure at which high-pressure fuel is supplied to the injector and a specification of a discharge line of the injector. That is, using the supply fuel pressure and the specification of the discharge line of the injector makes it possible to draw the geometry of the injection rate at which fuel is injected from the injector.

The fuel injection system employing the means according to a fifth aspect allows the geometry of the injection rate to be drawn in terms of the rising injection rate Qup provided when the needle rises in the injector, the falling injection rate Qdn provided when the needle falls in the injector, and the maximum injection rate Qmax applied when the rising injection rate Qup reaches a maximum injection rate.

In other words, for such a low level injection as the rising injection rate, Qup does not reach the maximum injection rate Qmax, the geometry of the injection rate is defined by the triangle specified in terms of the rising injection rate Qup and the falling injection rate Qdn. This results in a triangle having an area corresponding to the request injection quantity Q being expressed by a second order equation in terms of the duration of injection. Accordingly, the drive signal generation timing and the drive signal termination timing can be analytically determined from the triangle to implement the request injection timing and the request injection quantity Q.

On the other hand, for such a high level injection as the rising injection rate Qup reaching the maximum injection rate Qmax, the geometry of the injection rate is defined by the trapezoid specified in terms of the rising injection rate Qup, the maximum injection rate Qmax, and the falling injection rate Qdn. This results in a trapezoid having an area corresponding to the request injection quantity Q being expressed by a linear equation in terms of the duration of injection. Accordingly, the drive signal generation timing and the drive signal termination timing can be analytically determined from the trapezoid to implement the request injection timing and the request injection quantity Q.

The fuel injection system employing the means according to a sixth aspect determines the drive signal generation timing of the injector to be at a valve opening pressure achieving time Tds before a start point of formation in time of the injection rate against time geometry. The valve opening pressure achieving time (Tds) is measured from a valve opening command being given to the injector to an actual start of fuel injection by the injector.

The fuel injection system employing the means according to a seventh aspect determines the valve opening pressure achieving time Tds, the valve closing pressure achieving time Tde1, and the needle rise time Tqr, and then determines the duration Tqf measured from the drive signal generation timing to the drive signal termination timing of the injector by Tds+Tqr−Tde1. The fuel injection system employing the means according to an eighth aspect determines the needle rise time Tqr in terms of the request injection quantity Q, the rising injection rate Qup, and the falling injection rate Qdn.

The fuel injection system employing the means according to a ninth aspect determines the valve opening pressure achieving time Tds by the function of a pressure of the high-pressure fuel supplied to the injector and multiple-injection intervals at which fuel is injected separately a multiple number of times in one cycle. The fuel injection system employing the means according to a tenth aspect employs, when correcting for a variation in injection quantity, at least one of the injection parameters (Tds, Qup, Qdn, Qmax, Tde1, Tqr, and Tqf) as an adjustment parameter and stores the adjustment parameter as a learned value to reflect the value on the next injection. This arrangement allows for correction of a variation in injection quantity corresponding to the difference between individual fuel injection systems and the degradation therein.

The fuel injection system employing the means according to an eleventh aspect employs, when correcting for a variation in injection quantity, two or more of the two or more injection parameters (Tds, Qup, Qdn, Qmax, Tde1, Tqr, and Tqf) as adjustment parameters and weights the adjustment parameters to correct for the variation in injection quantity. The respective adjustment parameters are stored as a learned value to reflect the value on the next injection. This arrangement allows for correction of a variation in injection quantity corresponding to the difference between individual fuel injection systems and the degradation therein as well as a variation in injection timing (the commencement or termination of injection or both of them).

The fuel injection system employing the means according to a twelfth aspect estimates, when correcting for a variation in injection quantity, the variation in injection quantity as being caused by a change in a parameter of a predetermined portion defining a specification of the injector to employ the parameter of the predetermined portion as an adjustment parameter and store the adjustment parameter as a learned value to reflect the value on the next injection. The parameter of a predetermined portion defining the specification of the injector is corrected in this manner, thereby allowing for correction of the injection parameter determined using the parameter of the predetermined portion. That is, the geometry of a corrected injection rate is drawn, thus requiring no additional correction (such as injection quantity or injection timing).

To summarize the modes in which the fuel injection system operates, the controller of the fuel injection system determines the geometry defined by a change in injection rate of the injector with respect to time, and the drive signal generation timing and the drive signal termination timing of the injector from the geometry of the injection rate having an area corresponding to the request injection quantity Q.

The controller of the fuel injection system determines the geometry defined by a change in needle lift amount of the injector with respect to time and converts the geometry of the needle lift amount to determine the geometry of the injection rate. Then, the drive signal generation timing and the drive signal termination timing of the injector are determined from the geometry of the injection rate having an area corresponding to the request injection quantity Q.

The controller of the fuel injection system determines the geometry defined by a change in needle lift amount of the injector with respect to time. Then, the drive signal generation timing and the drive signal termination timing of the injector are determined from the geometry of the needle lift amount having an area corresponding to the request injection quantity Q.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiments is merely exemplary in nature and is in no way intended to limit the invention, its application, or uses.

First Embodiment

Figure 1:
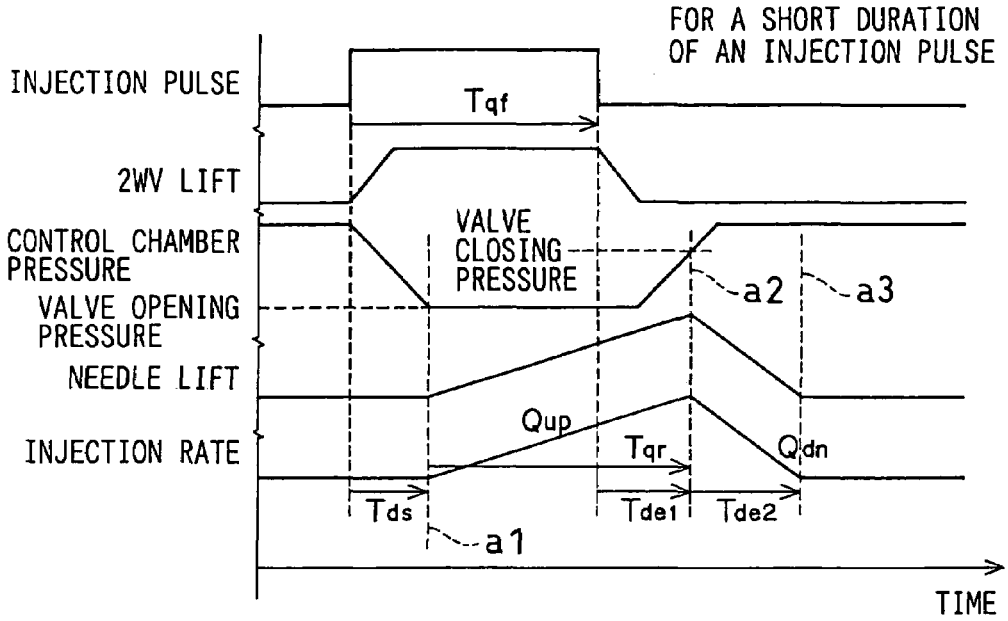
FIG. 1 is a graph illustrating relationships between a drive pulse and various injection parameters during a short duration injection pulse of an embodiment of the invention.
Figure 2:
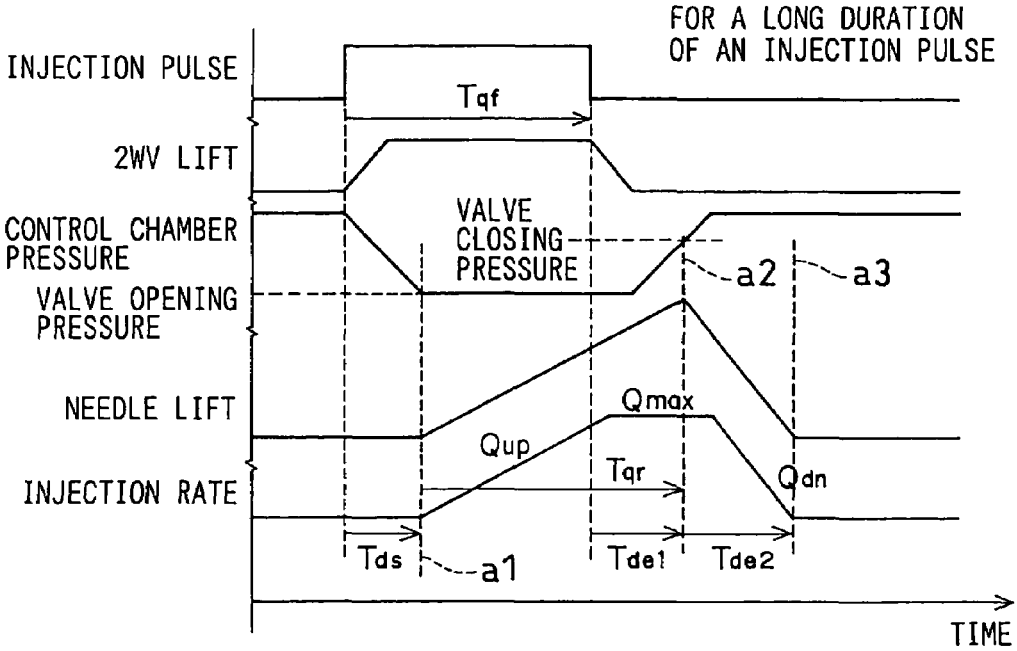
FIG. 2 is a graph illustrating relationships between a drive pulse and various injection parameters during a long duration injection pulse of an embodiment of the invention.
Figure 3:
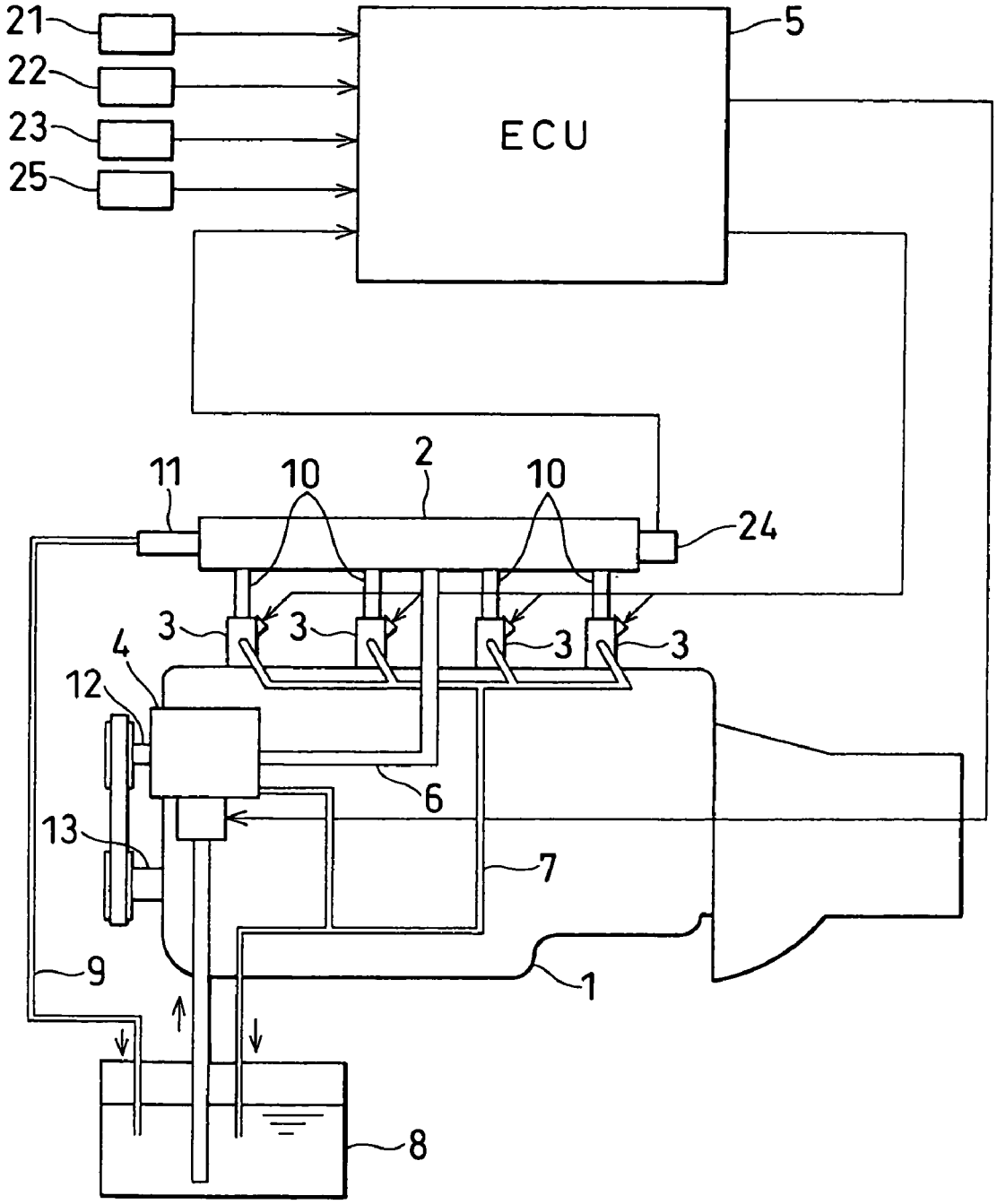
FIG. 3 is a schematic view illustrating a common rail fuel injection system of an embodiment of the invention.

Now, reference is made to FIGS. 1 to 4 to explain the first embodiment of the present invention, which is applied to a common rail fuel injection system. First, the configuration of the common rail fuel injection system will be explained with reference to FIG. 3. As an example, the common rail fuel injection system is designed to inject fuel into a diesel engine (hereinafter referred to as an engine) 1, and includes a common rail 2, injectors 3, a supply pump 4, and an ECU 5 (abbreviated as Engine Control Unit, corresponding to a controller). The engine 1 has a multiple number of cylinders, each of which experiences an intake, compression, combustion, and exhaust stroke. As an example, FIG. 3 shows a four-cylinder engine, however, the present invention is also applicable to an engine having a different number of cylinders.

The common rail 2 is an accumulator vessel for accumulating high-pressure fuel to be supplied to the injector 3. The common rail 2 is connected to the discharge port of the supply pump 4 in order to supply fuel under high pressure via a fuel line (high-pressure fuel passageway) 6 to accumulate pressure in the common rail 2 that corresponds to the fuel injection pressure. Fuel leakage from the injector 3 is returned to a fuel tank 8 via a leakage conduit (fuel return pipe) 7.

A relief conduit (fuel return passageway) 9 from the common rail 2 to the fuel tank 8 is provided with a pressure limiter 11. The pressure limiter 11 is a pressure relief valve, which opens when the pressure of fuel exceeds a pressure limit setpoint to reduce the pressure of fuel in the common rail 2 to below the pressure limit setpoint.

The injector 3 is mounted to each cylinder of the engine 1 to supply fuel into each cylinder by injection. The injector 3 is connected to the downstream end of a multiple number of high-pressure fuel conduits 10, which branch from the common rail 2, to supply high-pressure fuel accumulated in the common rail 2 to each cylinder by injection. The injector 3 will be described later in more detail.

The supply pump 4 is a fuel pump for supplying high-pressure fuel under high pressure to the common rail 2. The supply pump 4 includes a feed pump, for pumping fuel in the fuel tank 8 to the supply pump 4, and a high-pressure pump, for compressing the fuel pumped by the feed pump to a high pressure, to supply the fuel under high pressure to the common rail 2. The feed pump and the high-pressure pump are driven by a common camshaft 12. As shown in FIG. 3, the camshaft 12 is rotatably driven by a crankshaft 13 of the engine 1 or the like.

The supply pump 4 is also equipped with a pump control valve (not shown) for adjusting the quantity of fuel to be pumped by the high-pressure pump. The pump control valve is controlled by the ECU 5 to thereby adjust the common rail pressure. The ECU 5 is provided with a microcomputer of a known structure, which includes functions such as a CPU for performing control and operation processing, a storage device (a memory such as a ROM, a stand-by RAM or EEPROM, or RAM) for storing various programs and data, an input circuit, an output circuit, a power supply circuit, an injector drive circuit, and a pump drive circuit. Various operation processings are performed in accordance with the sensor signals (engine parameters, and signals responsive to the driving condition of the driver and the running condition of the engine 1) which are read into the ECU 5. As shown in FIG. 3, the sensors connected to the ECU 5 include an accelerator sensor 21 for sensing the degree of opening of the accelerator, an RPM sensor 22 for sensing the revolutions per minute of the engine, a water temperature sensor 23 for sensing the temperature of the cooling water in the engine 1, a common rail pressure sensor 24 for sensing the pressure of the common rail, and other sensors 25.

Now, the fuel injection control according to the first embodiment of the present invention will be described below. In the first embodiment, fuel is injected a multiple number of times during one cycle (multiple injections) to simultaneously provide a high level of prevention with regard to engine vibrations and noises, cleanness of exhaust gas, engine output, and fuel economy. The ECU 5 is designed to determine the request injection timing and the request injection quantity Q in response to the current running condition in accordance with a program stored in the ROM (such as maps) and an engine parameter read into the RAM. The ECU 5 then delivers a drive pulse to the injector 3 so as to obtain the request injection quantity Q at the request injection timing.

The control provided by the ECU 5 is explained below. The ECU 5 draws the geometry of the injection rate having an area corresponding to the request injection quantity Q to deliver a drive pulse to the injector 3 so as to obtain the request injection quantity Q at the request injection timing. This geometry is drawn in terms of the injection rate of the injector 3 with respect to time. The ECU 5 determines the drive signal generation timing (drive pulse ON timing) and the drive signal termination timing (drive pulse OFF timing) of the injector 3 from the geometry of the injection rate having an area corresponding to the request injection quantity Q (which is the function of the drive timing calculation means). The geometry of the injection rate is drawn to have the conditions of the pressure (e.g., a common rail pressure Pc) of high-pressure fuel to be supplied to the injector 3 and the specification of the discharge line of the injector 3.

Figure 4:
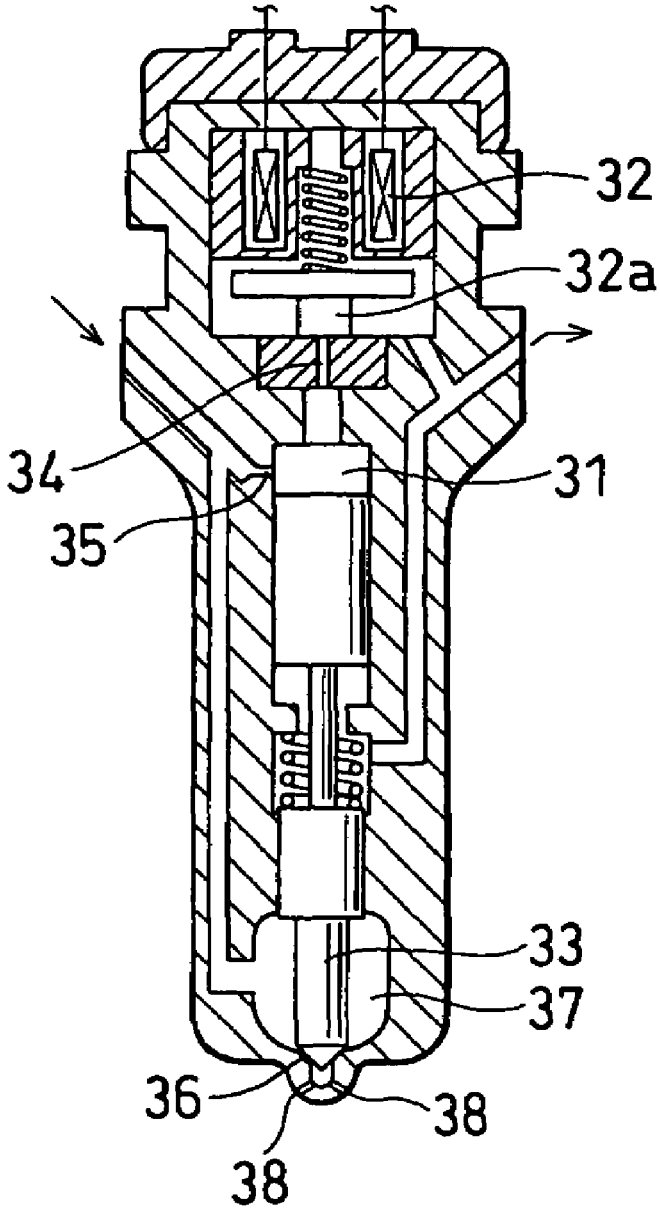
FIG. 4 is a cross-sectional view illustrating an injector of an embodiment.
Figure 5:
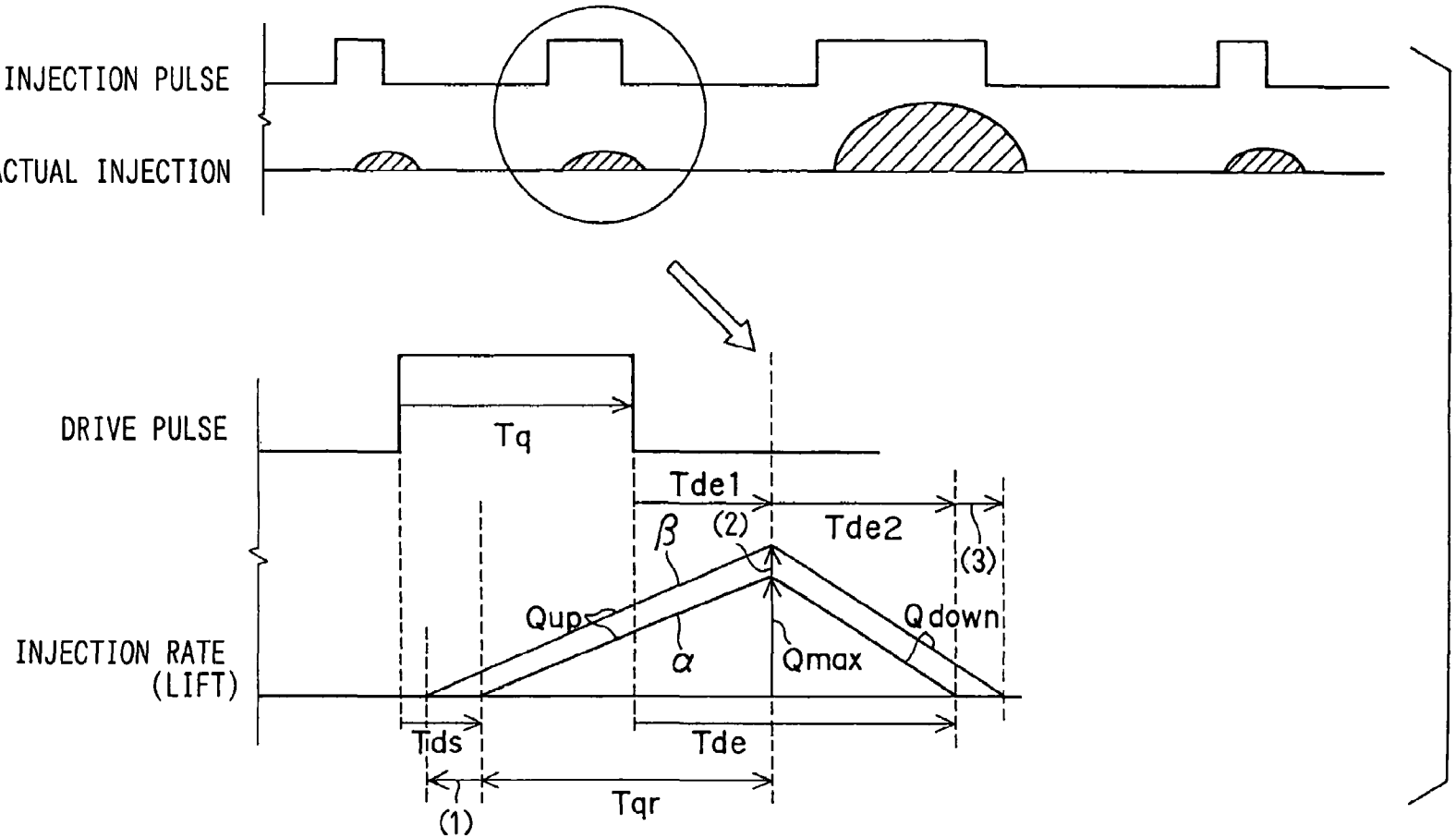
FIG. 5 PRIOR ART
FIG. 5 is a graph of an injection pulse and a drive pulse and how they correspond to an actual injection and an injection rate, respectively, of the prior art.

The operation principles of the injector 3 will now be explained with reference to FIGS. 1, 2, and 4. As shown in FIG. 4, the injector 3 of this type according to the first embodiment allows an electromagnetic valve 32 to control the pressure of a control chamber (back-pressure chamber) 31 in order to drive a needle 33. As shown in FIGS. 1 and 2, an injection pulse (pulse ON) given by the ECU 5 to the electromagnetic valve 32 allows a valve body (2WV in the figure) 32*a* of the electromagnetic valve 32 to start to be lifted up and an out-orifice 34 to open at the same time, thereby causing the pressure of the control chamber 31, decompressed by an in-orifice 35, to start decreasing.

A decrease in the pressure of the control chamber 31 to that of the valve opening pressure or less causes the needle 33 to start rising. Disengagement of the needle 33 from its nozzle seat 36 causes the nozzle chamber 37 to communicate with an injection hole 38, thereby allowing the fuel supplied under high pressure to the nozzle chamber 37 to be injected from the injection hole 38. The time from the drive pulse ON to the commencement of injection is called the valve opening pressure achieving time Tds. As the needle 33 rises, the injection rate increases. An increase in injection rate is called the rising injection rate Qup. When the rising injection rate Qup reaches the maximum injection rate Qmax, the injection rate will not increase further (see FIG. 2).

When the injection pulse given by the ECU 5 to the electromagnetic valve 32 is terminated (pulse OFF), the valve body 32*a* of the electromagnetic valve 32 starts being directed down. Then, when the valve body 32*a* of the electromagnetic valve 32 closes the out-orifice 34, the pressure of the control chamber 31 starts increasing. When the pressure of the control chamber 31 increases to the valve closing pressure or higher, the needle 33 starts lowering. The time from the pulse OFF to the commencement of the lowering of the needle 33 is called the valve closing pressure achieving time Tde1. The time from the commencement of the rising to the commencement of the lowering of the needle 33 is called the needle rise time Tqr, and a decrease in injection rate during the lowering of the needle 33 is called the falling injection rate Qdn.

The needle 33 lowering to engage the nozzle seat 36 blocks the communication between the nozzle chamber 37 and the injection hole 38, thereby terminating fuel injection from the injection hole 38, that is, the time from the commencement of the lowering of the needle 33 to the termination of injection is called time Tde2.

As described above, when the rising injection rate Qup does not reach the maximum injection rate Qmax (e.g., for a short duration injection), a triangular geometry results, as shown in FIG. 1, in terms of the injection rate, that is, the rising injection rate Qup and the falling injection rate Qdn, with respect to time. On the other hand, when the rising injection rate Qup reaches the maximum injection rate Qmax (e.g., for a large level injection), a trapezoidal geometry is produced, as shown in FIG. 2, in terms of the injection rate, that is, the rising injection rate Qup, the maximum injection rate Qmax, and the falling injection rate Qdn, with respect to time.

Now, each parameter of the geometry of the injection rate will be explained.

(1) When the rising injection rate Qup does not reach the maximum injection rate Qmax (e.g., for a short duration injection) and the geometry of the injection rate is a triangle;

Rising injection rate Qup=func (Pc, Tint)

Falling injection rate Qdn=func (Pc)

$$\text{Needle Rise Time } Tqr = \sqrt{\frac{2Q}{Q_{up}(1 + Q_{up}/Q_{dn})}} \quad \text{[Equation 1]}$$

Valve opening pressure achieving time Tds=func (Pc, Tint)

Valve closing pressure achieving time Tde1=func (Pc)

Injection pulse duration Tqf=Tqr+Tds−Tde1

Needle falling time Tde2=Tqr (Qup/Qdn)

(2) When the rising injection rate Qup reaches the maximum injection rate Qmax (e.g., for a long duration injection) and the geometry of the injection rate is a trapezoid;

Rising injection rate Qup=func (Pc, Tint)

Falling injection rate Qdn=func (Pc)

Maximum injection rate Qmax=func (Pc)

$$\text{Needle rise time } Tqr = Qdn/(Qup+Qdn) \times Q/Qm + \tfrac{1}{2} \times Qm/Qup \quad \text{[Equation 2]}$$

Valve opening pressure achieving time Tds=func (Pc, Tint)

Valve closing pressure achieving time Tde1=func (Pc)

Injection pulse duration Tqf=Tqr+Tds−Tde1

Needle falling time Tde2=Tqr (Qup/Qdn)

In the foregoing, Tint is an interval (injection interval) at which multiple injections are carried out, and the injection pulse duration Tqf corresponds to a period of time from the drive signal generation timing (drive pulse ON timing) to the drive signal termination timing (drive pulse OFF timing) of the injector 3. The "func" indicates a function (having the specified conditions of the discharge line of the injector 3) or a map stored in the storage device (the map being prepared based on the specified conditions of the discharge line of the injector 3), a numerical value being derived from the function or the map. The "Pc" is a common rail pressure read by the common rail pressure sensor 24, the common rail pressure corresponding to the pressure of the high-pressure fuel to be supplied to the injector 3.

In the foregoing, the needle rise time Tqr is determined in terms of the request injection quantity Q, the rising injection rate Qup, and the falling injection rate Qdn. That is, it is determined from the relationship between the geometry of the injection rate and the request injection quantity Q.

As described above, the valve opening pressure achieving time Tds may be determined from the function of the common rail pressure Pc and the interval Tint, or alternatively from a map (a three-dimensional map of the common rail pressure Pc, the interval Tint, and the valve opening pressure achieving time Tds). That is, a three-dimensional map of the common rail pressure Pc, the interval Tint, and the valve opening pressure achieving time Tds may be pre-stored in a ROM area of the ECU 5. Then, the valve opening pressure achieving time Tds may be determined from the three-dimensional map corresponding to the common rail pressure Pc associated with the running condition and the interval Tint determined by operation.

As shown in FIGS. 1 and 2, the ECU 5 determines the ON timing of the drive pulse to be at a valve opening pressure achieving time Tds before the start point of formation in time a1 of the geometry of the injection rate with respect to time. That is, the ON timing of the drive pulse is determined by a1−Tds.

As described above, the ON timing of the drive pulse is determined to be at the valve opening pressure achieving time Tds before the injector 3 actually starts to inject fuel, thereby enabling an injection to start at the request injection timing made by the ECU 5.

The ECU 5 also determines the injection pulse duration Tqf by adding the needle rise time Tqr to the valve opening pressure achieving time Tds and subtracting the valve closing pressure achieving time Tde1 therefrom. That is, the injection pulse duration Tqf is determined by Tds+Tqr−Tde1.

As described above, the interval between the ON and OFF states of the drive pulse is determined by the injection pulse duration Tqf to find the OFF timing of the drive pulse, thereby allowing the injector 3 to actually inject fuel of the request injection quantity Q made by the ECU 5.

In the first embodiment, such an example was shown in which the OFF timing of the drive pulse was determined in terms of the injection pulse duration Tqf. However, the OFF timing of the drive pulse may also be determined to be at the valve closing pressure achieving time Tde1 before a point in time a2 at which the pressure of the control chamber 31 reaches the valve closing pressure. That is, the OFF timing of the drive pulse may be determined by a2−Tde1. The OFF timing of the drive pulse may also be determined to be at the valve closing pressure achieving time Tde1 plus the needle falling time Tde2 before an end point of formation in time a3 of the geometry of the injection rate with respect to time. That is, the OFF timing of the drive pulse can be determined by a3−Tde1−Tde2.

As described above, the fuel injection system according to the first embodiment determines the ON and OFF timing of the drive pulse from the geometry of the injection rate having an area corresponding to the request injection quantity Q. This permits an operational result (the formation of the geometry of the injection rate) based on a change in valve opening pressure achieving time Tds to be automatically reflected on another operational result, such as the duration from the drive signal generation timing to the drive signal termination timing that is derived from the geometry of the injection rate.

That is, adaptation of only the valve opening pressure achieving time Tds that is varied by the effect of pulsation would make it possible to automatically determine the ON and OFF timing of the drive pulse corresponding to the request injection timing and the request injection quantity Q in accordance with the geometry of the injection rate (the aforementioned triangle or trapezoid) determined by the ECU 5.

This eliminates the need for the conventional individual correction maps and separate correction operations, thereby making it possible to significantly reduce the time for adaptation required of the ECU 5 as compared with the prior art.

Second Embodiment

In the first embodiment above, such an example was shown in which the rising injection rate Qup, the falling injection rate Qdn, and the maximum injection rate Qmax were directly determined, which were then used to determine the geometry of the injection rate. The example was also adapted such that the rising injection rate Qup, the falling injection rate Qdn, and the maximum injection rate Qmax were determined using the function or map based on the injector supply pressure (the common rail pressure Pc) and the specification of the injector 3. That is, in the first embodiment above, such an example was shown in which the geometry of the injection rate was directly determined using the function or map based on the injector supply pressure (the common rail pressure Pc) and the specification of the injector 3.

In contrast to this, in the second embodiment, a geometry defined by a change in needle lift quantity with respect to time is first determined, and then the geometry of needle lift quantity is converted to determine the geometry of the injection rate. Now, a method for converting the geometry of the needle lift quantity to determine the geometry of the injection rate will be explained below.

The injection region is divided into a seat aperture region and an injection hole aperture region. The seat aperture region is a region in which the injection quantity is determined by the supply fuel pressure and between the needle 33 and the nozzle seat 36, or the region of the aforementioned rising injection rate Qup and falling injection rate Qdn. The injection hole aperture region is a region in which the supply fuel pressure and the aperture level of the injection hole 38 determine the injection quantity, or the region of the aforementioned maximum injection rate Qmax.

When injection takes place only in the seat aperture region, the geometry of the needle lift quantity (a triangle) is converted into the geometry of the injection rate (a triangle). More specifically, a linear approximation is made to the injection flow rate against needle lift quantity characteristics (or the lift—flow rate characteristics) for an injection rate against needle lift quantity conversion (or the lift—injection rate conversion). This allows for drawing the geometry of the injection rate (a triangle) for the case of the rising injection rate Qup not reaching the maximum injection rate Qmax (e.g., for a short duration injection).

When injection is also carried out in the injection hole aperture region in addition to the seat aperture region, the geometry of the needle lift quantity (a trapezoid) is determined with the maximum value of the seat aperture region employed as the value of the injection hole aperture region. Then, the geometry of the needle lift quantity (a trapezoid) is converted into the geometry of the injection rate (a trapezoid). More specifically, a linear approximation is made to the injection quantity against the needle lift quantity characteristics (or the lift—flow rate characteristics) for an injection rate against needle lift quantity conversion (or the lift—injection rate conversion). This allows for drawing the geometry of the injection rate (a trapezoid) for the case of the rising injection rate Qup reaching the maximum injection rate Qmax (e.g., for a large level injection). The geometry of the injection rate determined in this manner can be used to provide the same effects as those of the first embodiment.

Third Embodiment

The ECU 5 is provided with a correction function for changing the quantity of injection (e.g., a function for correcting for variations between the cylinders) to eliminate a variation in revolutions per minute of the engine when the RPM sensor 22 or the like detects the variation. More specifically, when a variation is detected in the revolutions per minute of the engine, correction is made to the ECU 5 to change the quantity of injection to eliminate the variation. To this end, used as an adjustment parameter is at least one of the injection parameters (for preparing the geometry of the injection rate) consisting of the valve opening pressure achieving time Tds, the rising injection rate Qup, the falling injection rate Qdn, the maximum injection rate Qmax, the valve closing pressure achieving time Tde1, the needle rise time Tqr, and the injection pulse duration Tqf. Then, the correction value of the adjustment parameter is stored as a learned value to reflect the value on the next injection.

Of course, when the amount of the variation in the revolutions per minute of the engine is varied, the correction function works to update the correction value of the adjustment parameter in response to the amount of the variation as well as the updated correction value of the adjustment parameter as a learned value, thus there is continuous adjustment to eliminate variations in the revolutions per minute of the engine. The correction function including the learning function makes it possible to prevent deterioration in injection accuracy caused by the difference between individual fuel injection systems (variations between the injectors 3) and by degradation of the individual fuel injection systems (e.g., variations in seat diameter or the diameter of engagement of the needle 33 with the nozzle seat 36).

Fourth Embodiment

For the correction function according to the third embodiment above, such an example was shown in which correction was made using, as an adjustment parameter, at least one of the injection parameters consisting of the valve opening pressure achieving time Tds, the rising injection rate Qup, the falling injection rate Qdn, the maximum injection rate Qmax, the valve closing pressure achieving time Tde1, the needle rise time Tqr, and the injection pulse duration Tqf. In contrast to this, to correct for a variation in injection quantity, the correction function according to the fourth embodiment employs two or more of the injection parameters as adjustment parameters, while weighting the adjustment parameters for the correction of the variation in injection quantity and storing the respective adjustment parameters as a learned value to reflect the value on the next injection.

As a specific example, suppose that when a variation in revolutions per minute of the engine is detected, correction is made to eliminate the variation using as adjustment parameters the three parameters consisting of the valve opening pressure achieving time Tds, the rising injection rate Qup, and the falling injection rate Qdn. In this case, the heaviest weight is assigned to the degree of correction of the valve opening pressure achieving time Tds (e.g., weight 6), while a low weight is assigned to the degree of correction of the rising injection rate Qup and the falling injection rate Qdn (e.g., weight 2, respectively).

This arrangement allows for making correction to a variation in injection quantity corresponding to the difference between individual fuel injection systems and degradation thereof as well as in injection timing (the commencement or termination of injection or both of them).

Fifth Embodiment

For the correction function according to the third and fourth embodiment above, an example was shown in which when a variation in revolutions per minute of the engine was detected, correction was directly made to the value of the injection parameters (the valve opening pressure achieving time Tds, the rising injection rate Qup, the falling injection rate Qdn, the maximum injection rate Qmax, the valve closing pressure achieving time Tde1, the needle rise time Tqr, and the injection pulse duration Tqf) in order to eliminate the variation. To the contrary, when a variation in revolutions per minute of the engine is detected, the correction function according to the fifth embodiment estimates that the variation is caused by a change in the parameter of a predetermined portion defining the specification of the injector 3. Then, the function uses the parameter of the predetermined portion as an adjustment parameter and stores the adjustment parameter as a learned value to reflect the value on the next injection.

As a specific example, suppose that a determination is made using the valve opening pressure achieving time Tds=func (Dst, Qin, Qout). In the equation, "func" indicates a function or a map stored in a storage device as described above, Dst is the diameter of the seat (the seat diameter of engagement of the needle 33 with the nozzle seat 36, or an exemplary parameter of a predetermined portion), Qin is the aperture flow rate of the in-orifice 35, and Qout is the aperture flow rate of the out-orifice 34.

When a variation in revolutions per minute of the engine is detected, it is estimated that the variation is caused by a change in seat diameter defining the specification of the injector 3, and then the value of the seat diameter Dst is changed. That is, correction is made to the value of the seat diameter Dst in the valve opening pressure achieving time Tds=func (Dst, Qin, Qout), resulting in the value of the valve opening pressure achieving time Tds being corrected.

Furthermore, correction is made only once to the value of the seat diameter Dst, thereby causing the value of the other injection parameters prepared using the seat diameter Dst to also be corrected at the same time. The "other injection parameters" include the rising injection rate Qup, the falling injection rate Qdn, but not the valve opening pressure achieving time, Tds.

Correction is made to the parameter of a predetermined portion defining the specification of the injector 3, thereby simultaneously correcting an injection parameter that is determined using the parameter of the predetermined portion. That is, since the geometry of a corrected injection rate is drawn, no additional correction needs to be made to the injection quantity or the injection timing.

MODIFIED EXAMPLES

In each of the aforementioned embodiments, such an example was shown in which the effect of pulsation occurring during multiple injections was processed under a light operational load. However, the present invention is not limited to multiple injections but is also applicable to a single injection in which injection is carried out once in a cycle, for example.

In multiple injection applications, the invention may be applied such that the injection quantity to be provided in one cycle is divided into generally equal amounts, each to be injected separately in multiple injections. The present invention may also be applied to multiple injections in which the injection to be performed in one cycle is divided into a minor injection and a main injection so as to conduct the minor injection once or multiple times before the main injection. Alternatively, the present invention may also be applied to multiple injections in which the minor injection is conducted once or multiple times after the main injection, or to multiple injections in which the minor injection is conducted once or multiple times before and after the main injection.

In each of the aforementioned embodiments, such an example was shown which applied the present invention to the common rail fuel injection system in which fuel leakage occurred during the operation of the injector 3. However, the present invention may also be applied to a common rail fuel injection system of the type that allows a linear solenoid mounted to the injector 3 to directly drive the needle 33 without causing any fuel leakage. That is, the present invention may also be applied to the fuel injection system that incorporates the injector 3 of the type that directly drives the needle 33 by a piezoelectric injector or the like.

In each of the aforementioned embodiments, such an example was shown in which the geometry of the injection rate is drawn in terms of the rising injection rate Qup, the falling injection rate Qdn, and the maximum injection rate Qmax that is applied only when the rising injection rate Qup reaches the maximum injection rate. However, the geometry of the injection rate with respect to time can be drawn given that the pressure of the high-pressure fuel to be supplied to the injector 3 and the specification of the discharge line of the injector 3, such as the specification of an injection outlet or the set point of the valve opening pressure, are known. Accordingly, it is also acceptable to determine the geometry of the injection rate in accordance with the pressure of the high-pressure fuel to be supplied to the injector 3 and the specification of the discharge line of the injector 3.

In each of the aforementioned embodiments, such an example was shown in which the present invention was applied to the common rail fuel injection system. However, the present invention may also be applied to a fuel injection system that employs no common rail. That is, the present invention can also be applied to a fuel injection system that is used, for example, in a gasoline engine or engine that combusts a fuel other than diesel fuel.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A fuel injection system comprising:

an injector for injecting high-pressure fuel, and a controller for determining request injection timing and a request injection quantity in response to a running condition of an internal combustion engine to controllably open or close the injector in accordance with the request injection timing and the request injection quantity, the controller further comprising:

means for determining a multisided geometry defined by an actual change in injection rate of the injector with respect to time, the multisided geometry being determined based on a current pressure of the fuel supplied to the injector and a rising injection rate of the fuel which is previously measured and stored in the controller; and determining drive signal generation timing and drive signal termination timing of an injector control signal for the injector from the multisided geometry of the injection rate having an area corresponding to the request injection quantity.

2. A fuel injection system according to claim 1, wherein the fuel injection system determines a geometry defined by a change in needle lift amount of the injector with respect to time, and converts the geometry of needle lift quantity to determine the geometry of the injection rate.

3. A fuel injection system comprising:

an injector for injecting high-pressure fuel, and a controller for determining request injection timing and a request injection quantity in response to a running condition of an internal combustion engine to controllably open or close the injector in accordance with the request injection timing and the request injection quantity, the controller further comprising:

means for determining a multisided geometry defined by a change in injection rate of the injector with respect to time, the multisided geometry being determined based on a current pressure of the fuel supplied to the injector and a rising injection rate of the fuel which is previously measured and stored in the controller; and determining drive signal generation timing and drive signal termination timing of an injector control signal for the injector from the geometry of the injection rate having an area corresponding to the request injection quantity;

wherein the fuel injection system determines a geometry defined by a change in needle lift amount of the injector with respect to time, and converts the geometry of needle lift quantity to determine the geometry of the injection rate; and the determination of the geometry of the injection rate by converting the geometry of needle lift quantity includes dividing an injection region into a seat aperture region in which an injection quantity is determined between a needle and a nozzle seat of the injector and an injection hole aperture region in which an injection quantity is determined in accordance with an aperture level of an injection hole of the injector, making a linear approximation of injection flow rate against needle lift quantity characteristics in the seat aperture region for an injection rate against needle lift quantity conversion, and making a linear approximation of injection flow rate against needle lift quantity characteristics in the injection hole aperture region for an injection rate against needle lift quantity conversion.

4. A fuel injection system comprising:

an injector for injecting high-pressure fuel, and a controller for determining request injection timing and a request injection quantity in response to a running condition of an internal combustion engine to controllably open or close the injector in accordance with the request injection timing and the request injection quantity, the controller further comprising:

means for determining a geometry defined by a change in injection rate of the injector with respect to time, and determining drive signal generation timing and drive signal termination timing of an injector control signal for the injector from the geometry of the injection rate having an area corresponding to the request injection quantity;

wherein the geometry of the injection rate is a multisided geometry drawn based on a current pressure of the fuel supplied to the injector and a rising injection rate of the fuel which is previously measured and stored in the controller.

5. A fuel injection system according to claim 1, wherein the multisided geometry of the injection rate is determined in terms of said rising injection rate, said rising injection rate being provided when a needle rises in the injector, a falling injection rate provided when the needle falls in the injector, and a maximum injection rate applied when the rising injection rate reaches a maximum injection rate.

6. A fuel injection system according to claim 1, wherein the drive signal generation timing of the injector control signal for the injector is determined to be at a valve opening pressure achieving time before a start point of formation in time of the injection rate against time geometry, the valve opening pressure achieving time being measured from a valve opening command being given to the injector to an actual start of fuel injection by the injector.

7. A fuel injection system according to claim 1, wherein the fuel injection system determines a valve opening pressure achieving time measured from a start point of formation in time of the injection rate against time geometry until a valve opening command is provided to the injector to actually start injecting fuel, a valve closing pressure achieving time measured from a valve closing command being given to the injector until an injection rate actually starts falling, and a needle rise time measured from the start point of formation in time of the injection rate against time geometry until a control chamber of the injector reaches a valve closing pressure, and a duration measured from the drive signal generation timing to the drive signal termination timing of the injector is determined by Tds+Tqr−Tde1.

8. A fuel injection system according to claim 7, wherein the needle rise time is determined in terms of the request injection quantity, the rising injection rate, the rising injection rate being provided when the needle rises in the injector, and a falling injection rate provided when the needle lowers in the injector.

9. A fuel injection system comprising:

an injector for injecting high-pressure fuel, and a controller for determining request injection timing and a request injection quantity in response to a running condition of an internal combustion engine to controllably open or close the injector in accordance with the request injection timing and the request injection quantity, the controller further comprising:

means for determining a multisided geometry defined by a change in injection rate of the injector with respect to time, the multisided geometry being determined based on a current pressure of the fuel supplied to the injector and a rising injection rate of the fuel which is previously measured and stored in the controller; and determining drive signal generation timing and drive signal termination timing of an injector control signal for the injector from the geometry of the injection rate having an area corresponding to the request injection quantity;

wherein the drive signal generation timing of the injector control signal for the injector is determined to be at a valve opening pressure achieving time before a start point of formation in time of the injection rate against time geometry, the valve opening pressure achieving time being measured from a valve opening command being given to the injector to an actual start of fuel injection by the injector; and the valve opening pressure achieving time is determined by a function of a pressure of the high-pressure fuel supplied to the injector and multiple-injection intervals at which fuel is injected separately in a multiple number of times in once cycle.

10. A fuel injection system according to claim 1, wherein to correct for a variation in injection quantity, the controller employs at least one of the following injection parameters as an adjustment parameter, and stores the adjustment parameter as a learned value to reflect the value on a next injection, the injection parameters including a valve opening pressure achieving time measured from the start point of formation in time of the injection rate against time geometry until the valve opening command is provided to the injector to actually start injecting fuel, the rising injection rate, the rising injection rate being provided when a needle rises in the injector, a falling injection rate provided when the needle lowers in the injector, a maximum injection rate applied when the rising injection rate reaches a maximum injection rate, a valve closing pressure achieving time measured from a valve closing command being given to the injector until an injection rate actually starts falling, a needle rise time measured from a start point of formation in time of the injection rate against time geometry until the control chamber of the injector reaches a valve closing pressure, and a duration measured from the drive signal generation timing to the drive signal termination timing of the injector.

11. A fuel injection system according to claim 10, wherein to correct for a variation in injection quantity, the controller employs two or more of the injection parameters as adjustment parameters and weights the adjustment parameters to correct for the variation in injection quantity, and stores the respective adjustment parameters as a learned value to reflect the value on a next injection.

12. A fuel injection system according to claim 1, wherein to correct for a variation in injection quantity, the controller estimates the variation in injection quantity as being caused by a change in a parameter of a predetermined portion defining a specification of the injector to employ the parameter of the predetermined portion as an adjustment parameter and store the adjustment parameter as a learned value to reflect the value on a next injection.

13. A method of controlling a fuel injection system utilizing an injector for injecting high-pressure fuel, the method comprising:

providing a controller for determining request injection timing and a request injection quantity in response to a running condition of an internal combustion engine;

controllably opening or closing the injector in accordance with the request injection timing and the request injection quantity;

determining a multisided geometry defined by an actual change in injection rate of the injector with respect to time, the multisided geometry being determined based on a current pressure of the fuel supplied to the injector and a rising injection rate of the fuel which is previously measured and stored in the controller; and determining a drive signal generation timing and a drive signal termination timing of an injector control signal for the injector from the multisided geometry of the injection rate having an area corresponding to the request injection quantity.

14. The method of controlling a fuel injection system according to claim 13, the method further comprising:

determining a geometry defined by a change in needle lift amount of the injector with respect to time; and converting the geometry of needle lift amount to determine the multisided geometry of the injection rate.

15. A method of controlling a fuel injection system utilizing an injector for injecting high-pressure fuel, the method comprising:

providing a controller for determining request injection timing and a request injection quantity in response to a running condition of an internal combustion engine;

controllably opening or closing the injector in accordance with the request injection timing and the request injection quantity;

determining a multisided geometry defined by a change in injection rate of the injector with respect to time, the multisided geometry being determined based on a current pressure of the fuel supplied to the injector and a rising injection rate of the fuel which is previously measured and stored in the controller; and determining a drive signal generation timing and a drive signal termination timing of an injector control signal for the injector from the geometry of the injection rate having an area corresponding to the request injection quantity;

determining a geometry defined by a change in needle lift amount of the injector with respect to time; and converting the geometry of needle lift amount to determine the geometry of the injection rate;

determining the geometry of the injection rate by converting the geometry of needle lift amount by:

dividing an injection region into a seat aperture region in which an injection quantity is determined between a needle and a nozzle seat of the injector and an injection hole aperture region in which an injection quantity is determined in accordance with an aperture level of an injection hole of the injector;

making a linear approximation of injection flow rate against needle lift amount characteristics in the seat aperture region for an injection rate against needle lift amount conversion; and making a linear approximation of injection flow rate against needle lift amount characteristics in the injection hole aperture region for an injection rate against needle lift amount conversion.

16. A method of controlling a fuel injection system utilizing an injector for injecting high-pressure fuel, the method comprising:

providing a controller for determining request injection timing and a request injection quantity in response to a running condition of an internal combustion engine;

controllably opening or closing the injector in accordance with the request injection timing and the request injection quantity;

determining a multisided geometry defined by a change in injection rate of the injector with respect to time, the multisided geometry being determined by a current pressure of the fuel supplied to the injector and a rising injection rate of the fuel which is previously measured and stored in the controller;

determining a drive signal generation timing and a drive signal termination timing of an injector control signal for the injector from the geometry of the injection rate having an area corresponding to the request injection quantity; and developing the geometry of the injection rate in accordance with conditions of a pressure at which high-pressure fuel is supplied to the injector and a specification of a discharge line of the injector.

17. The method of controlling a fuel injection system according to claim 13, the method further comprising:

developing the multisided geometry of the injection rate in accordance with said rising injection rate, said rising injection rate being provided when a needle rises in the injector, a falling injection rate provided when the needle falls in the injector, and a maximum injection rate applied when the rising injection rate reaches a maximum injection rate.

18. The method of controlling a fuel injection system according to claim 13, further comprising:

determining the drive signal generation timing of the injector control signal for the injector to be at a valve opening pressure achieving time before a start point of formation in time of the injection rate against time geometry; and measuring the valve opening pressure achieving time from a valve opening command being given to the injector to an actual start of fuel injection by the injector.

19. The method of controlling a fuel injection system according to claim 13, the method further comprising:

determining a valve opening pressure achieving time measured from a start point of formation in time of the injection rate against time geometry until a valve opening command is provided to the injector to actually start injecting fuel;

determining a valve closing pressure achieving time measured from a valve closing command being given to the injector until an injection rate actually starts falling;

determining a needle rise time measured from the start point of formation in time of the injection rate against time geometry until a control chamber of the injector reaches a valve closing pressure; and determining a duration measured from the drive signal generation timing to the drive signal termination timing of the injector by Tds+Tqr−Tde1.

20. The method of controlling a fuel injection system according to claim 19, further comprising:

determining the needle rise time in terms of:

a request injection amount, the rising injection rate, the rising injection rate being provided when a needle rises in the injector, and a falling injection rate provided when the needle falls in the injector.

* * * * *